United States Patent [19]

McBrian

[11] Patent Number: 4,470,039

[45] Date of Patent: Sep. 4, 1984

[54] PREMISE ALARM SHUNT ARRANGEMENT

[75] Inventor: John E. McBrian, Kinnelon, N.J.

[73] Assignee: American Standard Inc., New York, N.Y.

[21] Appl. No.: 422,137

[22] Filed: Sep. 23, 1982

[51] Int. Cl.³ ..... G08B 29/00

[52] U.S. Cl. ..... 340/514; 340/501; 340/506; 340/531

[58] Field of Search ..... 340/514, 502, 500, 501, 340/506, 507, 510, 511, 512, 513, 515, 516, 527, 528, 531

[56] References Cited

U.S. PATENT DOCUMENTS

| | | | |
|---|---|---|---|
| 3,588,865 | 6/1971 | Hansen | 340/510 |
| 3,662,372 | 5/1972 | Levy | 340/506 |
| 3,772,667 | 11/1973 | Falck, Jr. | 340/510 |
| 3,820,102 | 6/1974 | Schubert | 340/528 |
| 4,015,256 | 3/1977 | Pratt | 340/533 |
| 4,024,519 | 5/1977 | Galvin et al. | 340/514 |
| 4,117,479 | 9/1978 | Galvin et al. | 340/525 |
| 4,118,700 | 10/1978 | Lenihan | 340/524 |
| 4,206,450 | 6/1980 | Harden et al. | 340/514 |
| 4,270,121 | 5/1981 | Verr | 340/514 |

*Primary Examiner*—Donnie L. Crosland

*Attorney, Agent, or Firm*—Wood, Herron & Evans

[57] ABSTRACT

A shunt arrangement for a premise alarm system which includes a plurality of secure/alarm zone signal inputs and a plurality of alarm circuit outputs. In the shunt arrangement, logic circuitry disables the coupling of the secure/alarm zone signal inputs from the alarm circuit outputs. The shunt arrangement is activated by a shunt switch located remotely from the logic circuitry, and the logic circuitry further includes an indicator light for indicating a zone alarm condition when the shunt switch is activated. The logic circuitry further includes a local test switch operable to produce simulated alarm circuit outputs although the shunt switch is activated.

7 Claims, 1 Drawing Figure

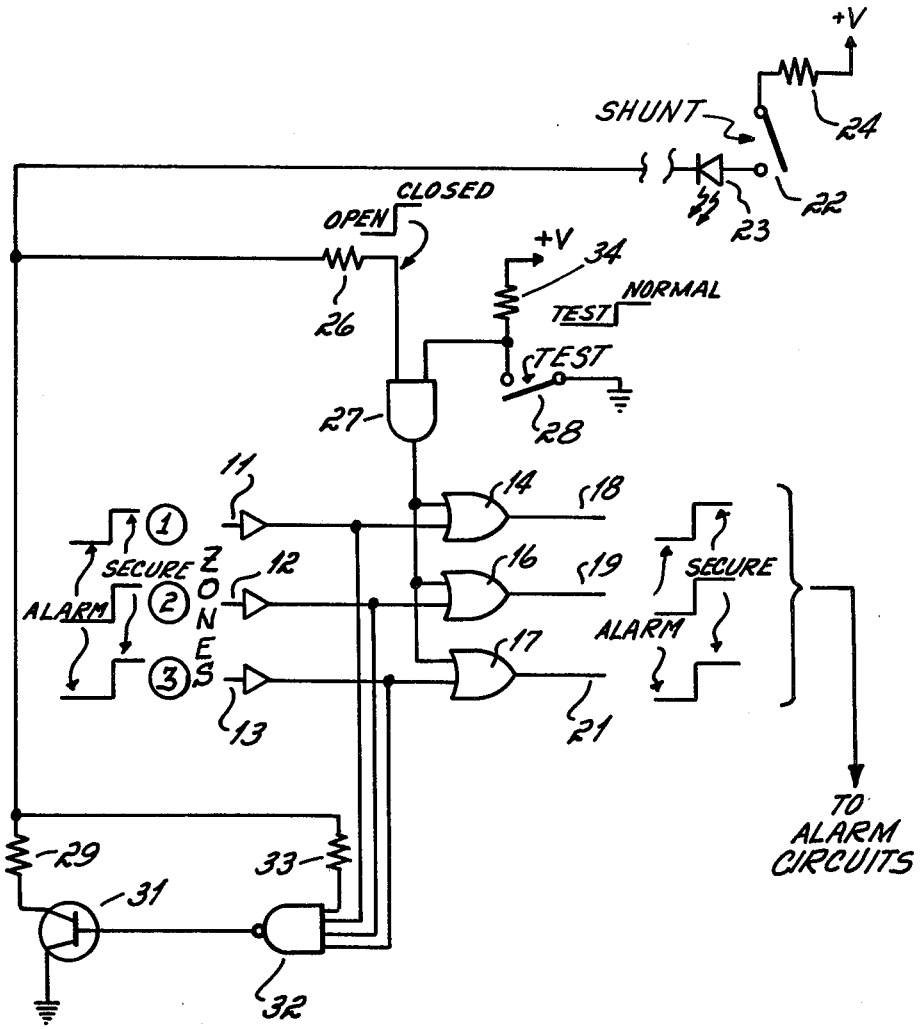
+V
SHUNT
24
22
23
CLOSED
OPEN
26
+V
34
NORMAL
TEST
TEST
28
27
11
14
18
1
SECURE
ZONES
12
16
19
SECURE
ALARM
2
ALARM
17
3
13
21
TO ALARM CIRCUITS
29
33
31
32

PREMISE ALARM SHUNT ARRANGEMENT

DESCRIPTION OF THE INVENTION

This invention relates generally to premise alarm systems and more particularly concerns a shunt arrangement for such an alarm system.

In a typical premise alarm system, a number of protected zones are wired within intrusion sensors coupled together in series or in parallel and electrically energized so as to produce zone signals which may be characterized as either "secure" or "alarm" signals. For example, a zone might include a room having a number of windows and a door. Each of these entryways is provided with an intrusion sensor of known type and the sensors are connected together to provide a single zone signal output. For example, each door or window may be provided with a switch having a normally closed pair of switch contacts wherein the switches are connected in series.

Each of the zone signals is normally coupled through a premise alarm control to sound an appropriate alarm if a zone alarm signal is received, indicative of unauthorized entry into a zone. Such an alarm may be local, or remote, or both. When a premise is protected in such a fashion, to permit authorized entry to the premise, normally a shunt switch is provided so that one who is authorized to enter the premise, and is able to activate the shunt switch, can enter the premise after disabling some or all of the zones protected by the premise alarm system. Usually, the shunt switch is located outside the protected premise at a door, and the shunt is established by turning a key in a key switch. One or more protected zones of the premise are then disconnected from the alarm outputs.

One means for effecting the shunting of one or more zones of the premise alarm is to switch a substitute element, or loop, in place of the zone circuit and to couple this simulated zone circuit to the alarm system control. In this way, a secure zone signal is provided regardless of the actual condition of the zone intrusion sensors. This approach, however, has the disadvantage of removing the zone loops from the system so that their conditions are unknown. This causes a difficulty, for example, when it is desired to reactivate (unshunt) the premise alarm system. If an intrusion sensor remains activated, such as due to a partially opened window or from residual activation of a motion sensor as an authorized person moves through the premise to the shunt switch, unshunting the alarm system will produce an alarm circuit output activating the local and/or remote alarms.

Another common aspect of prior shunted premise alarm systems is the placement of the shunt switch at a location remote from the premise alarm control. For example, it is usual to place the shunt switch outside a door of the protected premise. With such a remotely located shunt switch, should it be desired to test the alarm outputs by introducing simulated zone alarm signals, this cannot be accomplished at the local alarm system control location. To test such a system the shunt switch must be opened at the remote location.

It is the general aim of the invention to provide a shunt arrangement for premise alarm systems of the foregoing type which permits a determination of the secure condition of shunted zones prior to unshunting the alarm system. It is a related objective of the invention to further provide such a shunt arrangement in which alarm system outputs may be tested without the need for unshunting the system.

In carrying out the invention, circuitry is provided for coupling the secure/alarm zone signal inputs from the previous zones to alarm circuit outputs, with a shunt switch operable to disable the coupling by this circuitry. An indicator is provided, generally near the shunt switch and coupled to the shunt switch and to the secure/alarm zone signal inputs, for providing an indication of an alarm zone signal which is present during times that the shunt switch disables the coupling circuitry.

In accordance with another aspect of the invention, a test switch is provided for enabling the coupling circuitry to produce simulated alarm circuit outputs, with the alarm zone signal indicator remaining responsive to the zone signals.

Other objects and advantages of the invention, and the manner of their implementation, will become apparent upon reading the following detailed description and upon reference to the drawing.

BRIEF DESCRIPTION OF THE DRAWING

The single FIGURE is a circuit diagram of a premise alarm shunt arrangement in accordance with the present invention.

While the invention is susceptible to various modifications and alternative forms, a specific embodiment thereof has been shown by way of example in the drawings and will herein be described in detail. It should be understood, however, that it is not intended to limit the invention to the particular form disclosed, but, on the contrary, the intention is to cover all modifications, equivalents, and alternatives falling within the spirit and scope of the invention as defined by the appended claims.

Referring now to the FIGURE, the inputs from an exemplary three zones of a premise are coupled through the circuitry of the shunt arrangement to three alarm circuit outputs. In theory, any number of zones, one or more, may be accommodated. In the illustrated form of the invention, the received zone signal inputs are two-level logic signals. A logic high is a "secure" zone signal and a logic low is an "alarm" zone signal. These zone signal inputs 11, 12 and 13 are coupled through respective buffer amplifiers and OR gates 14, 16 and 17 to corresponding alarm signal outputs 18, 19 and 21. The zone signal inputs may be provided in many known ways including, for example, a closed loop of normally closed switches powered by a positive voltage source. The alarm signal outputs may be coupled directly to audible alarms on the protected premise or may be processed further in many known fashions. For example, the alarm outputs may be telephonically coupled by a control circuit having an automatic dialer to a remote location. In the absence of the present shunt arrangement, the zone signal inputs 11, 12 and 13 could, of course, be directly coupled to the alarm signal outputs 18, 19 and 21, respectively. Since the various possible zone input and alarm output configurations are not critical to the practice of the present invention, they shall not be discussed further herein.

In accordance with the invention, in the illustrated shunt arrangement, closing a shunt switch 22 disables the coupling of the zone signal inputs 11, 12 and 13 from the alarm circuit outputs 18, 19 and 21 by means of the OR gates 14, 16 and 17, while enabling a light emitting diode 23 near the shunt switch to provide a visual indication of an alarm condition at one or more of the zones. In order to disable the coupling by the OR gates 14, 16 and 17, a logic high is coupled through a dropping resistor 24, the closed shunt switch 22, the light emitting diode 23, a current limiting resistor 26, and an AND gate 27 to one of the two inputs of each of the OR gates. Since the output of each OR gate is a logic high if either of its inputs is high, the logic high provided by means of the shunt switch 22 maintains each OR gate output at a logic high. Therefore, the condition at the other input to each OR gate, from each of the zone signal inputs, has no effect on the OR gate output. Therefore, the alarm circuit outputs are held at the "secure" level when the shunt switch 22 is closed, ignoring for the moment the operation of a test switch 28 to be discussed hereinafter.

The current drawn by the AND gate 27 through the LED 23 is insufficient to illuminate the LED. However, the cathode of the LED 23 is also coupled through a current limiting resistor 29 and a transistor 31 to ground, and the LED 23 is illuminated if the transistor is turned on. This will occur in the event of a zone alarm signal from one of the three zones.

To turn on the transistor 31 and illuminate the LED 23 in the event of a zone alarm signal at one or more zones, each zone signal input is coupled to an input of a NAND gate 32 whose output is coupled to the base of the transistor 31. A fourth input to the NAND gate 32 is coupled through an input resistor 33 from the cathode of the LED 23. If the shunt switch 22 is closed, this fourth input to the NAND gate 32 is at a logic high. If the zone signal inputs 11, 12 and 13 are all at a logic high (secure condition), the other three inputs to the NAND gate 32 are also high. If all four inputs of the NAND gate 32 are high, its output is low and the transistor 31 is turned off. Therefore, if all of the zones are in the secured condition and the shunt switch 22 is closed, the LED 23 is not illuminated, which provides a visual indication that all of the zones associated with the shunt switch 22 are secure. If one or more of the zone signal inputs goes to a logic low, indicative of an alarm condition in that zone, the output of the NAND gate 32 goes high, and the transistor 31 turns on, illuminating the LED 23. The illuminated LED, in turn, provides a visual indication that one or more of the zones associated with the shunt switch 22 are not secure.

If the shunt switch 22 is opened, the input from the cathode of the LED 23 to the NAND gate 32 goes to a logic low, but the LED is not illuminated since its anode has been removed from the voltage supply. Therefore, it can be seen that without requiring any additional electrical connections to the zones, the collective zone status is monitored when the shunt switch 22 is closed.

In practice, the shunt switch 22 and the LED 23 are located remotely from the balance of the circuitry in the illustrated shunt arrangement. In order to permit testing the alarm system without the need for opening the shunt switch 22, the test switch 28 is provided. In order to accommodate the test switch 28, the second inputs of the OR gates 14, 16 and 17 are not directly coupled to the shunt switch 22. Instead these OR gate inputs are connected to the output of an AND gate 27 having one input coupled to the shunt switch 22. The other input to the AND gate 27 is connected to the test switch 28.

In normal operation, the test switch 28 is open and a supply voltage producing a logic high is coupled through a current limiting resistor 34 to the second input of the AND gate 27. Therefore, during normal operation, the logic high from the closed shunt switch 22 and the logic high coupled through the resistor 34 produce a logic high at the output of the AND gate 27, which maintains the outputs of the OR gates 14, 16 and 17 at a logic high (secure) condition. If it is desired to test the system by re-enabling the coupling of the zone signal inputs to the alarm circuit outputs by the OR gates, the test switch 28 is closed. This places a logic low at one of the AND gate 27 inputs, and the output of the AND gate goes to a logic low, which is coupled to the second inputs of the OR gates 14, 16 and 17. In turn, this permits the zone signal inputs to be coupled through the OR gates just as if the shunt switch 22 had been opened.

In using the premise alarm shunt arrangement of the present invention, an authorized person arrives at the protected premise and closes the shunt switch outside an entry thereto. Inside the premise the test switch 28 at the alarm circuitry location may be used at any time to test the zone alarm system. When the authorized person leaves the premise, he moves through certain of the protected, but now shunted, zones to the entryway at which the shunt switch is located. Before unshunting the alarm system, he checks the LED 23, and if it is illuminated, he waits for it to go out. This will occur, for instance, if the person has moved through a zone protected by a motion detector in exiting the premise, and the motion detector has not settled. If the LED goes out or is out, the authorized person unshunts the alarm system. If it remains illuminated, the various zones must be checked to determine the cause of the alarm output.

While only a single embodiment of the present invention is described, those persons skilled in the art to which the invention pertains will readily appreciate certain changes and modifications which may be made without departing from the spirit of the invention. For example, negative logic gates rather than positive logic gates could be utilized. In addition, the number of zones associated with the shunt switch could be as few as one or, in theory, as many as desired.

What is claimed is:

1. A shunt switch arrangement for an alarm system which has a plurality of secure/alarm zone signal inputs and a plurality of alarm circuit outputs comprising:

means for coupling the secure/alarm zone signal inputs to the alarm circuit outputs;

shunt switch means for, in a disabling condition, disabling the coupling means from coupling the secure/alarm zone signal inputs to the alarm circuit outputs; and indicator means near the shunt switch means, coupled to the shunt switch means and the secure/alarm zone signal inputs, for providing an indication of an alarm zone signal at a secure/alarm zone signal input when the shunt switch means disables the coupling means.

2. The shunt switch arrangement of claim 1 in which the shunt switch means further includes test switch means for enabling the coupling means with the shunt switch means remaining in its disabling condition.

3. The shunt switch arrangement of claim 2 in which, when the test switch means enables the coupling means, the indicator means remains responsive to an alarm zone signal at a secure/alarm zone signal input when the shunt switch means remains in its disabling condition.

4. The shunt switch arrangement of either claim 2 or claim 3 in which the shunt switch means comprises a shunt switch located remotely from the coupling means and the test switch means.

5. The shunt switch arrangement of claim 1 in which the indicator means comprises a visual indicator coupled in series with a controlled switching device and further comprising logic circuitry coupled to each of the zone signal inputs to produce a signal to control the controlled switching device.

6. The shunt switch arrangement of claim 5 in which the coupling means comprises a plurality of OR gates, a different one of which is coupled between each zone signal input and a respective alarm circuit output.

7. The shunt switch arrangement of claim 6 in which the shunt switch means comprises a normally open switch coupled between the OR gates and a dc power source.

* * * * *